US006547512B1

(12) United States Patent
Hummel et al.

(10) Patent No.: US 6,547,512 B1
(45) Date of Patent: Apr. 15, 2003

(54) STACK CHANGING DEVICE

(75) Inventors: Peter Hummel, Offenbach (DE); Robert Ortner, Alzenau (DE); Bernd Ullrich, Kahl/Main (DE); Harald Wolski, Rodgau (DE)

(73) Assignee: Man Roland Druckmaschinen AG (DE)

( * ) Notice: Subject to any disclaimer, the term of this patent is extended or adjusted under 35 U.S.C. 154(b) by 0 days.

(21) Appl. No.: 09/367,031

(22) PCT Filed: Feb. 3, 1998

(86) PCT No.: PCT/EP98/00563

§ 371 (c)(1),
(2), (4) Date: Aug. 30, 1999

(87) PCT Pub. No.: WO98/34862

PCT Pub. Date: Aug. 13, 1998

(30) Foreign Application Priority Data

Feb. 5, 1997 (DE) ..... 197 04 285

(51) Int. Cl.[7] ..... B65H 1/26
(52) U.S. Cl. ..... 414/795.8; 271/158; 271/159
(58) Field of Search ..... 271/157, 158, 271/159; 414/795.8

(56) References Cited

U.S. PATENT DOCUMENTS

| | | | | | |
|---|---|---|---|---|---|
| 2,690,337 | A | * | 9/1954 | Halahan et al. | 271/159 |
| 4,021,710 | A | * | 5/1977 | Fichte et al. | 271/159 X |
| 4,174,831 | A | * | 11/1979 | Marass et al. | 271/159 |
| 5,011,126 | A | * | 4/1991 | Suzuki et al. | 271/159 X |
| 5,295,681 | A | * | 3/1994 | Blaser | 271/159 X |
| 5,405,130 | A | * | 4/1995 | Maas | 271/159 X |
| 5,538,238 | A | * | 7/1996 | Filsinger | 271/159 |
| 5,803,446 | A | * | 9/1998 | Leuthold et al. | 271/159 X |

FOREIGN PATENT DOCUMENTS

| | | | | |
|---|---|---|---|---|
| DE | 1 095 297 | | 12/1960 | |
| DE | 26 37 086 | * | 12/1977 | 271/159 |
| DE | 39 31 710 A | | 4/1990 | |
| DE | 42 03 500 A | | 8/1993 | |
| EP | 0 604 770 A | | 7/1994 | |
| WO | WO 96/32349 A | | 10/1996 | |

* cited by examiner

*Primary Examiner*—Janice L. Krizek
(74) *Attorney, Agent, or Firm*—Leydig, Voit & Mayer, Ltd.

(57) ABSTRACT

A remaining-stack carrying device (3) in a sheet feeder (2) is used in non-stop stack changing. The remaining-stack carrying device (3) is integrated into the stack feeder (2) to simplify retrofitting. A remaining-stack lifting gear (5) uses the lifting elements present in each sheet feeder (2) for lifting and lowering during stack exchange.

9 Claims, 5 Drawing Sheets

STACK CHANGING DEVICE

FIELD OF THE INVENTION

The present invention relates to sheet-fed printing machines and, more particularly to an improved stack changing device for sheet feeders of sheet-fed printing machines.

BACKGROUND OF THE INVENTION

It is a known practice, in sheet feeders of sheet printing machines or other sheet-processing machines to provide arrangements for automated stack changing. These can consist of rack-type structures, so-called remaining-stack carrying devices, which are provided with thrusting and lifting drives for horizontal and vertical movement. Such so-called nonstop stack changers are suited for example during the printing of paper sheets, i.e. in machine running, to remove remainders of worked-out sheet stacks from a pallet provided, for example, with grooves and to deposit them again on a new sheet stack subsequently installed into the sheet feeder. Known devices are marked by high construction and assembly expenditures, and require special constructions of the sheet feeders. Further, devices are used in which the remaining-stack carrying device(s) have a rack engaging into the grooves of the pallet. This rack has to be removed when the remaining-stack is joined with the newly installed sheet stack to form a whole stack comprising the two stack parts. This involves high driving forces, and very severely strains the sheets of the stack lying next to the section point. Furthermore, restraining means have to be provided that prevent a shifting of the stack parts, and in so doing severely strain the stack edges. Furthermore, the operation of the sheet feeder itself is severely hampered or even rendered impossible. The sheetflow is difficult to control during the changing process, so that again and again waste sheets result.

Devices have already been developed that partly avoid some of the disadvantages described. Thus, from DE 3931710 C2 there is known a nonstop sheet feeder for rotary sheet-fed printing machines. It has a remaining-stack carrying device which is arranged underneath a conveyor table. The remaining-stack carrying device has a closed frame on which nonstop rods are arranged, which can be driven as piston rods of individual cylinders by means of a pressure medium, and which are drivable into grooves of a pallet carrying a sheet stack. The nonstop rods lie in the driven-in state on both sides of the frame and are to be removed successively from the area of the sheet feeder. Nothing is said about the sequence of operation. The bridging of the gap conditioned by the nonstop rods between main stack and remaining-stack constitutes, in the stack unification, an obstacle to a faultless continuous process. The device is not usable, since the sheet stack must be tilted.

From DE 4203500 A1 a sheet feeder is known. It has parallel to the sheet feeder and allocated to the sheet feeder on the face side, an auxiliary stack carrying device as an independent component. With this device, over a common drive, there are provided individually drivable pointed bars which are drivable into grooves of a pallet carrying a sheet stack. The drive has individual chain drives which are coupleable onto the respective pointed bars. For guiding and accessing the chain drives, special constructive measures are required. The chain drives completely block the space in front of the sheet feeder, so that the latter is not accessible. In the stack changing, the pointed bars are removed from the stack zone, in the joining of main stack and remaining-stack, first on the outside, then in the middle, and last in the zone between the already pulled pointed bars, so that there is supposed to result a gentle depositing of the remaining-stack on the sheet stack. This, however, is possible with the requisite precision only in the case of heavy materials, such as sheets of metal, since the sheets arch in different directions and must descend over a large gap that is formed by the pointed bars.

Further, from DAS 1095297 a sheet carrier with several stack-lifting mechanisms is known. It has a fork-shaped remaining-stack carrying device, which is provided with remaining-stack bars slidable into grooves of a pallet. The device makes possible the taking over of a remainder of a sheet stack from the pallet for the continuous in-feed of the sheets while a new sheet stack is installed into the sheet feeder. The remaining-stack is connected with a separate lifting mechanism parallel to the main stack lifting mechanism inside the sheet feeder, so that the remaining-stack is continuously liftable. The operating range of the remaining-stack carrying device is restricted. The remaining-stack carrying device hampers access of the sheet feeder.

OBJECTS AND SUMMARY OF THE INVENTION

In view of the foregoing, an object of the present invention is to provide an improved stack changing device which overcomes the problems associated with prior art designs.

A more specific object of the present invention is to provide a stack changing device which can be easily integrated into a sheet feeder.

The present invention provides these and other advantages and overcomes the drawbacks of the prior art by providing a stack changing device which utilizes an improved apparatus for receiving a remaining-stack and transferring the remaining stack to a newly fed-in sheet stack.

It is advantageous that carrying bars movable independently from one another are provided in the device, which for the unburdening of the sheet material are pulled out of the stacking zone not simultaneously, but offset from one another. The drive forces are thereby kept low and the cost of the drives of the remaining-stack bars is reduced. The device can be used, therefore, instead of a manual nonstop arrangement on a sheet feeder, and also be reequipped without the need for expensive constructive measures and large space requirements.

These and other features and advantages of the invention will be more readily apparent upon reading the following description of preferred exemplary embodiments of the invention and upon reference to the drawings wherein:

While the invention will be described and disclosed in connection with certain preferred embodiments and procedures, it is not intended to limit the invention to those embodiments. Rather it is intended to cover all such alternative embodiments and modifications as fall within the spirit and scope of the invention.

DETAILED DESCRIPTION OF PREFERRED EMBODIMENTS

Figure 1:
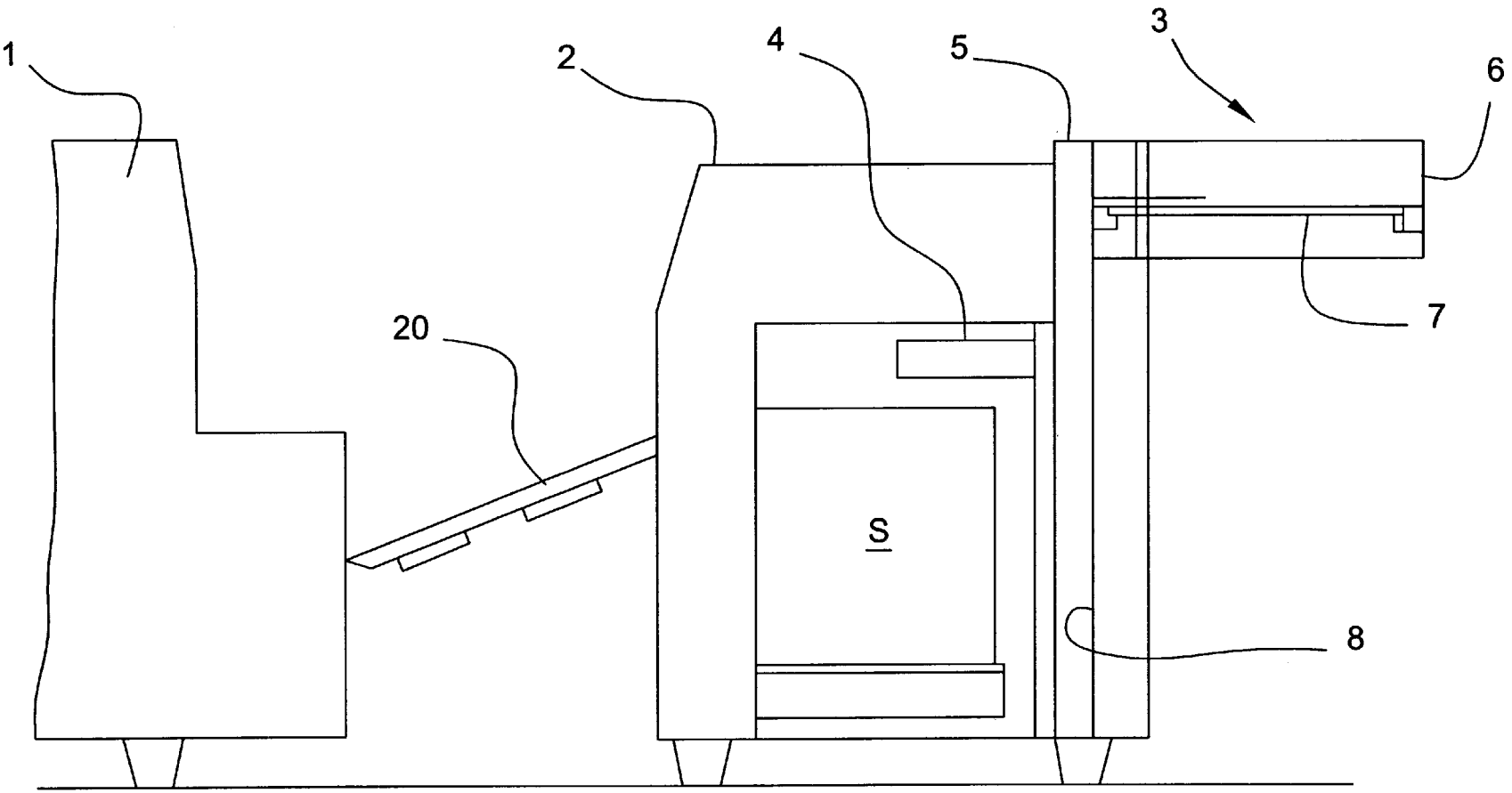
FIG. 1 is a side elevation view of an illustrative embodiment of a sheet feeder constructed in accordance with the present invention.

In FIG. 1 a sheet feeder 2 is represented joined with a sheet processing machine, for example with a sheet printing machine 1. In the sheet feeder 2 there is installed a sheet stack S for processing. The sheet stack S can be lifted by means of a main stack lifting mechanism, which is not shown in detail here, in the rhythm of the sheet processing. The sheets of the sheet stack S are singled on its upper side and fed to the sheet printing machine 1 in a sheet stream. In the sheet feeder 2 there is provided, for this purpose, a sheet singling arrangement 4. In the sheet feeder 2 there is arranged, further, a remaining-stack carrying device 3 which is assigned to the face side of the sheet feeder 2 turned away from the sheet printing machine 1.

The remaining-stack carrying device 3 is provided with a frame, in which there are borne, longitudinally shiftably, remaining-stack bars 7. By means of the frame 6 the remaining-stack carrying device 3 is suspended on a remaining-stack lifting mechanism 5. The remaining-stack lifting mechanism 5, here, is shown only in its position, but not in details. The remaining-stack lifting mechanism 5 serves to hold a remaining-stack in the sheet feeder 2, and to lift it in the rhythm of the sheet processing. For this reason the remaining-stack lifting mechanism 5 is also controllable synchronously with the main-stack lifting mechanism. The remaining-stack lifting mechanism consists of vertical guide rails 8 connected with the sheet feeder 2, on which (rails) the frame 6 is guided, and it has, for example, lifting chains by means of which the remaining-stack carrying device 3 is raisable or lowerable.

Figure 2:
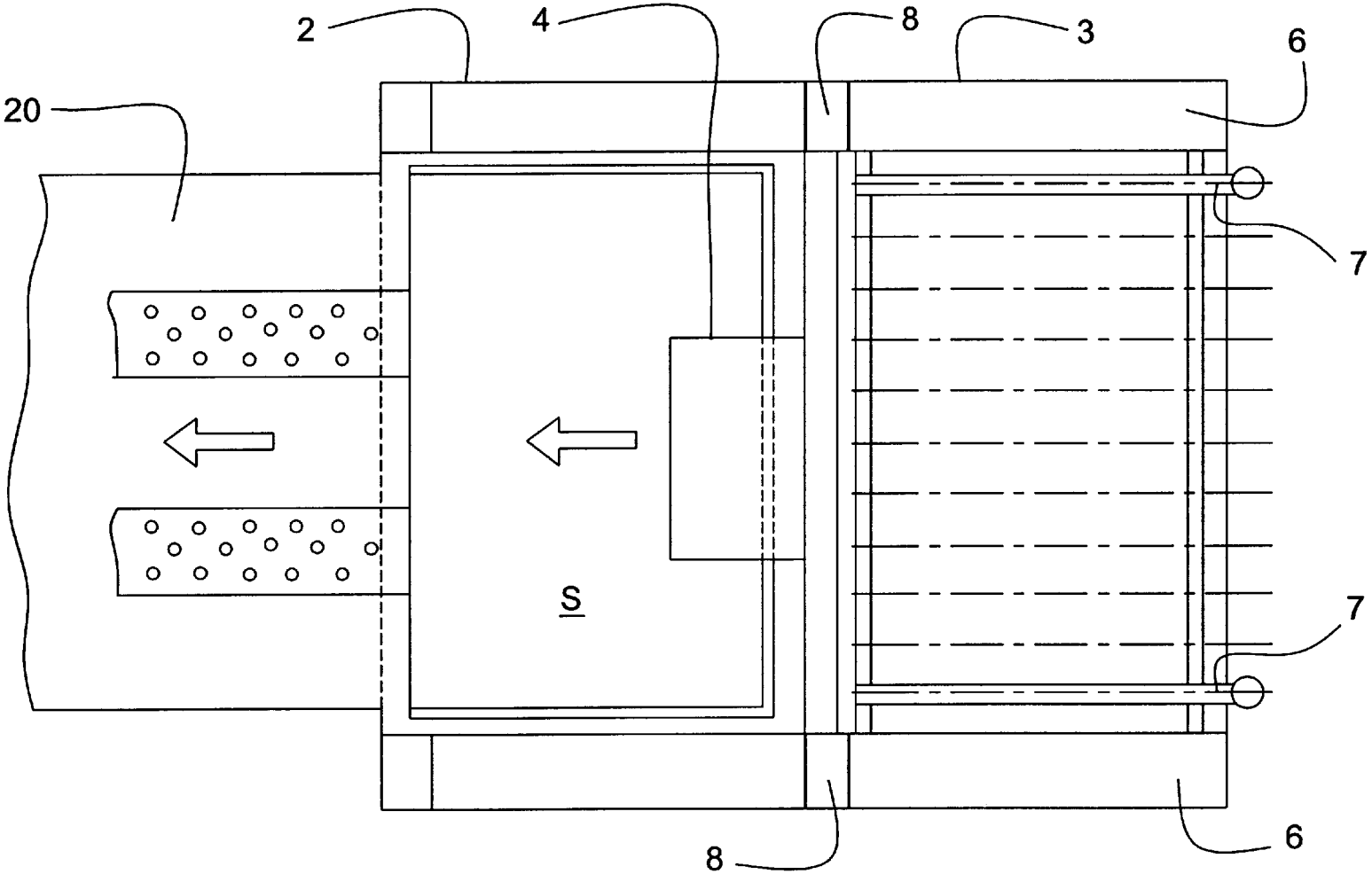
FIG. 2 is a plan view of a sheet feeder.

In FIG. 2 the sheet feeder 2 is shown in a top view. Upon the sheet feeder 2 there follows in the sheet running direction, indicated by an arrow, a so-called conveyor table 20, over which the sheet stream generated by the singling is transported to the sheet-processing machine, for example to the printing machine 1. The orientation of the remaining-stack bars 7 is represented in their arrangement with respect to the sheet feeder 2, only the two outer remaining-stack bars 7 being shown, while others are indicated with action lines. The position shown is, for example, the readiness position before the onset of a changing process, or the waiting position outside of the servicing zone of the sheet feeder 2. The remaining-stack bars 7 are guided there inside the remaining-stack carrying device 3, so that in the position shown they occupy a horizontal placement outside the range of the sheet feeder 2. The remaining-stack bars 7 are subdivided into thicker carrying bars and thinner spacing bars and are arranged in an alternating arrangement.

The remaining-stack carrying device 3 with its frame 6 is guided by means of the guide rails 8 on the sheet feeder 2, and it is vertically movable. The remaining-stack lifting mechanism 5 is indicated in its position and is located as is generally the case on the upper side of the guide rails 8, for example on the frame of the sheet feeder 2, it engages from there onto the rack 6 of the remaining-stack carrying device 3 and moves the latter up and down on the guide rails 8.

FIG. 1 shows that the remaining-stack carrying device 3 is installed directly into the sheet feeder 2, by means of the guide rails 8. The remaining-stack lifting mechanism 5, on the one hand, is movable up and down during the supplying of the printing machine 1 with sheets, and the remaining-stack carrying device 3, on the other hand, is movable outside of the processing zone for the stack changing proper.

The stack changing proceeds, therefore, as follows:

I. Start on reaching a limit height of the sheet stack S.

II. Remaining-stack bars 7 are thrust in common from the rack 6 into the grooves of the pallet underneath the sheet stack S.

III. Carrying bars are undercut by a remaining-stack lifting rail and raised until the remaining-stack H is carried by the carrying bars 7.

IV. The pallet is lowered and removed from the sheet feeder 2.

V. Lifting of the remaining-stack with the remaining-stack lifting mechanism 5 to the sheet singling element.

VI. Install the new sheet stack S into the sheet feeder 2.

VII. On contact of the upper side of the sheet stack S with the carrying bars the pulling process is initiated: the carrying bars 7 are pulled in pairs from inside outward between the remaining-stack H and the sheet stack S.

VIII. The remaining-stack places itself from inside and outward upon the spacing bars.

IX. The remaining-stack lifting rail becomes free, the remaining-stack carrying device 3 no longer takes on any load, the spacing bars control the stack unification.

X. Spacing bars are continuously drawn out from inside outward between the remaining-stack and the sheet stack S.

XI. Remaining-stack deposits itself continuously on the sheet stack S.

In a modified version of the run-off, the following procedure is followed:

I. Remaining-stack carrying device 3, after pulling of the carrying/spacing bars is immediately lowered to the stack underedge of the new sheet stack S.

II. The carrying/spacing bars are introduced into the grooves of the pallet, in which operation the thrusting-in path is shorter than the total thrusting-in path.

III. Remaining-stack carrying device 3 is raised load free, synchronously with the sheet stack S.

IV. On reaching the limit height of the sheet stack S the carrying/spacing bars are thrust-in entirely.

V. The remaining-stack lifting rail takes over the carrying bars.

The run-off is continued as described above.

Figure 3:
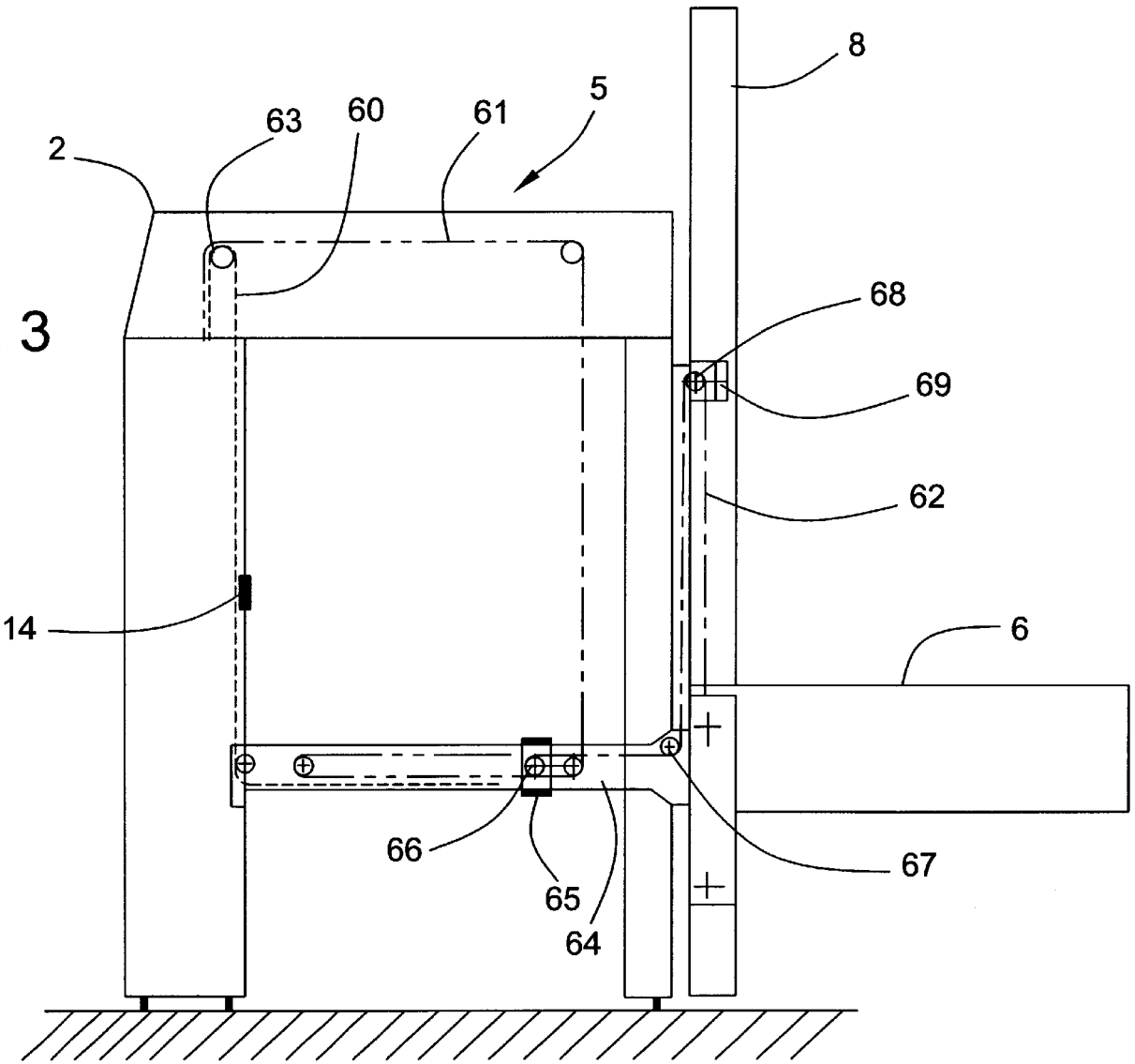
FIGS. 3–5 are schematic side views of the sheet feeder of FIG. 1 showing the operation of the stack changing device.
Figure 4:
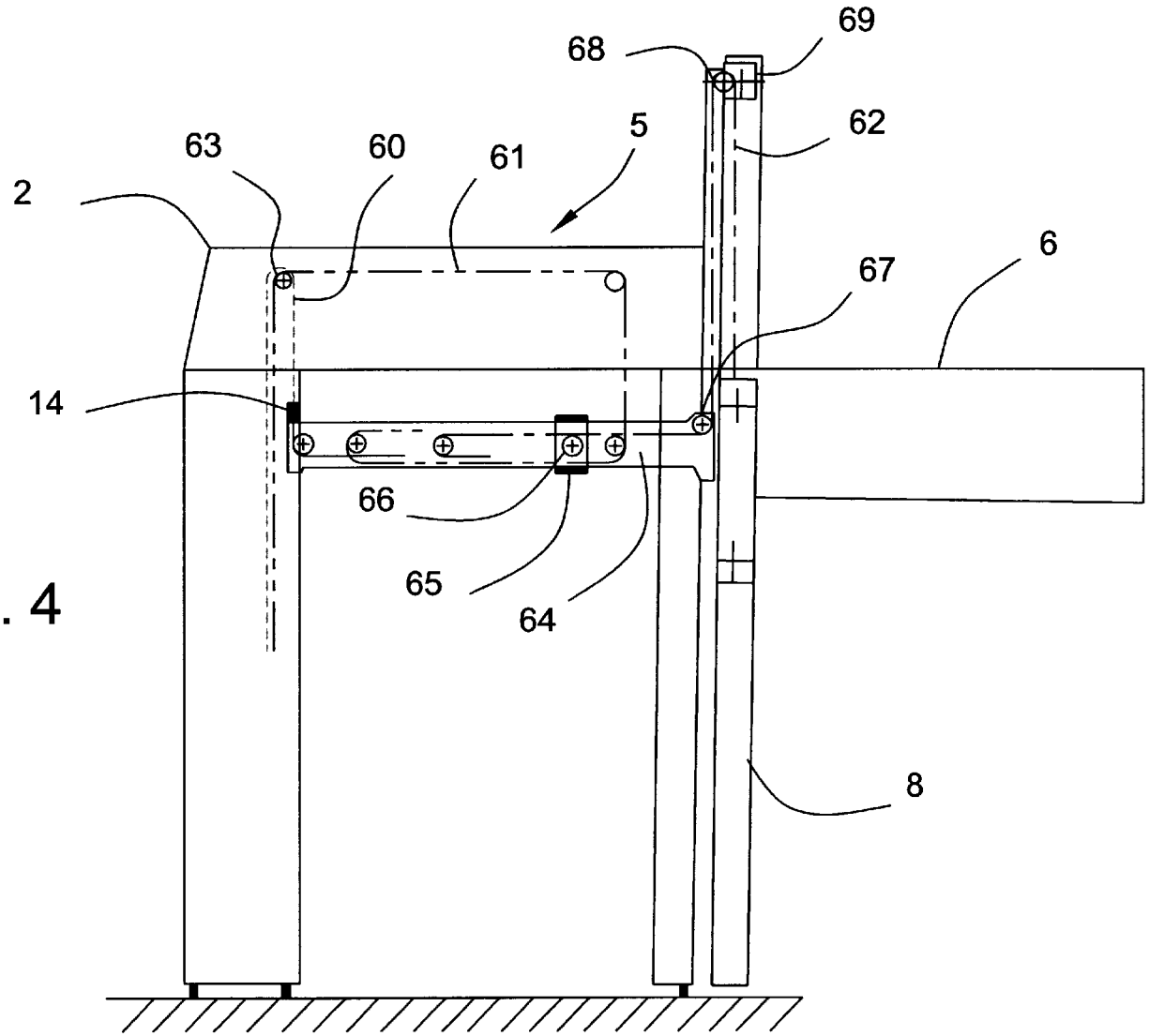
Figure 5:
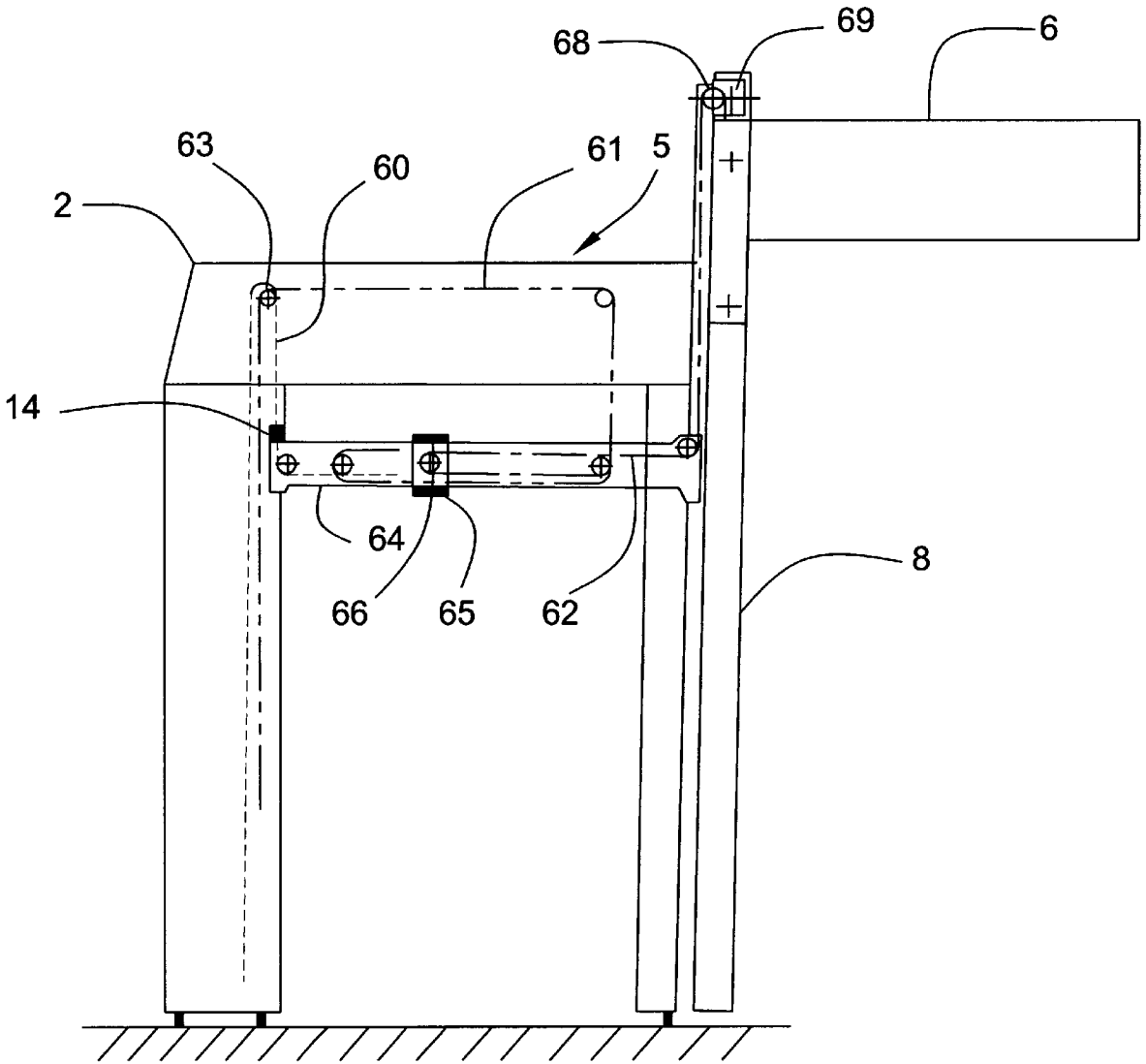

For implementing this run-off, in FIGS. 3 to 5 how the remaining-stack lifting mechanism 5 functions is schematically shown. The remaining-stack lifting mechanism 5 has three pairs of lifting chains 60, 61 and 62. The lifting chains 60 (dashed) are arranged on the front side of the remaining-stack lifting mechanism 5 corresponding to the sheet-processing machine. On this side the remaining-stack lifting rail is also coupled with the lifting chains 60. It lies, for example, in a vertical guide on supporting stops (not shown here) and can be lifted from there by means of the remaining-stack lifting mechanism 5. The lifting chains 61 (line double-pointed) are assigned to the oppositely lying rear side of the remaining-stack lifting mechanism 5. The lifting chains 62 (dotted-dashed) are assigned to the rack 6 of the remaining-stack carrying device 3. The lifting chains 60 and 61 (dashed-double-dotted) are led over chain-deflecting wheels in the frame of the sheet feeder 1 to a remaining-stack lifting drive 63. The lifting chains 60 to 62 are led on both sides of the sheet feeder 2 over deflecting wheels (here only indicated) in traverses 64. The traverses 64 are joined in the frame of the sheet feeder 2 with the remaining-stack carrying device 3 and are guided vertically slidably on the guide rails 8 in common with the remaining-stack carrying device 3 by means of the remaining-stack lifting mechanism 5. The traverses 64 have supports on their front ends on which the remaining-stack lifting rail can be led along. For this, the remaining-stack lifting rail, in the lifting movement of the remaining-stack lifting mechanism 5 and therewith of the traverses 64, is lifted off from its lower end position or waiting position, and raised with the remaining-stack carrying device 3. The remaining-stack lifting rail can obviously also be firmly joined with the traverses 64.

The ends of the lifting chains 60 and 61 are firmly joined on the traverses 64 with a slidable bearing block 65. On the slidable bearing block 65 there is borne a deflecting chain wheel 66. Around the deflecting chain wheel 66 the lifting chain 62 is led in a loop. The lifting chain 62 is further led over a deflecting chain wheel 67 from the traverse 64 upward to a deflecting chain wheel 68 on a support 69 carried along with the remaining-stack carrying device 3, or on the upper end of the guide rail 8 and it extends from there downward again. The ends of the lifting chain 62 are firmly attached, on the one hand, to the traverse 64 and, on the other hand, to the frame 6 of the remaining-stack carrying device 3. As a consequence of the weight of the remaining-stack carrying device 3 together with the traverses 64, the lifting chain 62 is tensioned over the loop about the deflecting chain wheel 66 against the lifting chains 60 and 61 and therewith also against the remaining-stack lifting drive 63.

In the bottom position shown in FIG. 3, the lifting chains 60 and 61 are largely driven out. The slidable bearing block 65, with the deflecting chain wheel 66, is fixed in this operating position by means of the chain loop, to the right against a stop. The frame 6 of the remaining-stack carrying device 3 is suspended by the lifting chains 62. The frame can also become seated, with respect to the traverses downward on a stop. The lifting chain 62 is then tensioned over the chain loop on the bearing block 65.

In the raising of the remaining-stack carrying device 3, as shown in FIG. 4, the lifting chains 60 and 61 are drawn in by the remaining-stack lifting drive 63. The bearing block 65 is further held over the chain loop in its right hand end position bounded by the length of the lifting chain 62. In the highest possible operating position of the remaining-stack carrying device 3 in the stack zone the traverses 64 run against stops, which are not shown in this case. Now a further lifting movement of the traverses 64 together with the rack 6 is not possible.

In FIG. 5 finally there is shown the out-of-operation position of the remaining-stack carrying device 3. By further actuating of the remaining-stack lifting drive 63, over the lifting movement of the lifting chains 60 and 61, the bearing block 65 is shifted to the left on the traverses 64. Here the lifting chain 62 runs off over the deflecting chain rolls 66, 67 and 68. The loop in the lifting chain 62 is lengthened there, while the end of that lifting chain 62 that is fastened to the rack 6 is drawn in. Thereby, the frame 6 is lifted by the traverses 64 and raised beyond the upper-end position of the traverses 64. The frame 6 carrying the remaining-stack bars 7 of the remaining-stack carrying device 3 is thus brought into a parked position. In this position it is taken out of operation.

In the lowering of the rack 6 and extension of the traverses 64 the two parts of the remaining-stack carrying device 3 join again and descend in common under the weight load with tensioned lifting chain 62.

The remaining-stack lifting mechanism 5 also is otherwise constructed with further details. Thus, the lifting action of the lifting chain 62 can be increased or decreased by altered deflections in the area of the loop. In this case, for example, there comes in question the action of a pulley block. Further, the connection both of the bearing block 65 and also the connection of the frame 6 with the traverses 64 can be made lockable. This, however, according to experiences of hitherto, is not required.

The remaining-stack carrying device 3, integrated into the sheet feeder with automatic hoisting of the rack 6 carrying the remaining-stack bars 7, permits the re-equipping of existing sheet feeders 2 with the equipment mentioned for the automatic stack changing. In this instance, despite extended functional possibilities, no additional construction space is required as is the case with other known devices.

What is claimed is:

1. A device for changing a sheet stack in a sheet feeder of a sheet-processing machine, the device comprising:

a main stack lifting mechanism for raising and lowering of a sheet stack, a remaining-stack carrying device including remaining-stack bars for temporarily receiving a remaining stack and transferring said remaining stack to a newly fed-in sheet stack, a drive mechanism for slidably moving the remaining-stackbars longitudinally into a stack position in staggered relation to one another and retracting the remaining-stack bars from the stacking position in staggered relation to one another, and a remaining-stack lifting mechanism for raising the remaining-stack carrying device, wherein the remaining-stack carrying device includes a first portion connected to the remaining-stack lifting mechanism and a second portion that carries the remaining-stack bars, the first and second portions of the carrying device being guided on vertical guide rails mounted on the sheet feeder with the first portion of the carrying device being arranged inside the sheet feeder and the second portion of the carrying device being arranged outside of the sheet feeder.

2. The stack changing device according to claim 1 wherein the remaining-stack lifting mechanism has an automatic drive connection with a lifting arrangement for moving the second portion of the carrying device with respect to the first portion of the carrying device on the vertical guide rails.

3. The stack changing device according to claim 1 wherein the first portion of the carrying device comprises traverses connected with the remaining-stack lifting mechanism and the second portion of the carrying device comprises a rack for carrying the remaining-stack bars, the traverses and rack being guided together on the vertical guide rails.

4. The stack changing device according to claim 3 wherein the rack is vertically movable on the guide rails with respect to the traverses by a lifting device.

5. The stack changing device according to claim 3 wherein the traverses include guides for a remaining-stack lifting rail which is guided vertically on the front side of the sheet feeder, the remaining-stack lifting rail being coupleable with the guides through the lifting movement of the remaining-stack carrying device such that the remaining-stack lifting rail is raisable from a lower end position together with the remaining-stack carrying device.

6. The stack changing device according to claim 5 wherein the remaining-stack lifting mechanism includes two pairs of lifting chains, a first drive mechanism for lifting a remaining stack, and a second drive mechanism for moving the rack with respect to the traverses.

7. The stack-changing device according to claim 6 wherein the rack is connected to the traverses by leading the lifting chains over chain deflecting rollers on the upper end of the guide rails.

8. The stack changing device according to claim 7 wherein the second drive mechanism includes a bearing block which is slidably mounted on the traverses and to which each of the lifting chains of the remaining-stack lifting mechanism is connected, and a rack lifting chain which is looped around a deflecting roller on the bearing block.

9. The stack changing device according to claim 8 further comprising stops for limiting the upward movement of the traverses on the guide rails.

* * * * *